United States Patent [19]

Mitsuhashi et al.

[11] Patent Number: 4,936,747

[45] Date of Patent: Jun. 26, 1990

[54] COMPRESSOR WITH CONDITION RESPONSIVE CUT-OFF MEANS

[75] Inventors: Hiroshi Mitsuhashi; Harutsugu Ushiota; Akiharu Odagiri; Gen Kano; Susumu Sakamoto, all of Kanagawa, Japan

[73] Assignee: Tokico Ltd., Kanagawa, Japan

[21] Appl. No.: 195,677

[22] Filed: May 18, 1988

[30] Foreign Application Priority Data

May 19, 1987 [JP] Japan ..... 62-73736

[51] Int. Cl.[5] ..... F04B 49/02

[52] U.S. Cl. ..... 417/32; 417/44; 340/679

[58] Field of Search ..... 417/32, 1, 44; 340/679, 340/652; 92/5 R

[56] References Cited

U.S. PATENT DOCUMENTS

| | | | |
|---|---|---|---|
| 2,786,989 | 3/1957 | Smith | 340/679 |
| 2,946,203 | 7/1960 | Carver . | |
| 3,338,255 | 8/1967 | Exline et al. | 417/32 |
| 3,877,837 | 4/1975 | Parker et al. | 417/32 |
| 4,073,184 | 2/1978 | Collins | 349/679 |
| 4,535,624 | 8/1985 | Ginns et al. | 73/119 R |

FOREIGN PATENT DOCUMENTS

| | | |
|---|---|---|
| 1503466 | 11/1970 | Fed. Rep. of Germany . |
| 1943936 | 3/1971 | Fed. Rep. of Germany . |

OTHER PUBLICATIONS

Industriekurier No. 149, Apr. 27, 1967, p. 614.

*Primary Examiner*—Leonard E. Smith
*Assistant Examiner*—David W. Scheuermann
*Attorney, Agent, or Firm*—Wenderoth, Lind & Ponack

[57] ABSTRACT

An air compressor includes a crankcase, a cylinder secured to the crankcase, a crankshaft disposed inside the crankcase and adapted to be rotated by a drive means, a piston reciprocatively installed inside the cylinder, and a connecting rod for connecting the crankshaft to the piston. Part of the drive power circuit of the drive means is constructed so as to be cut off when displacement of the constituent members of the compressor other than predetermined displacement occurs and/or when the temperature inside the compressor rises above a predetermined value. Thus the passage of electric current to the drive means is cut off, the compressor being brought to a halt without causing secondary damage to develop.

3 Claims, 3 Drawing Sheets

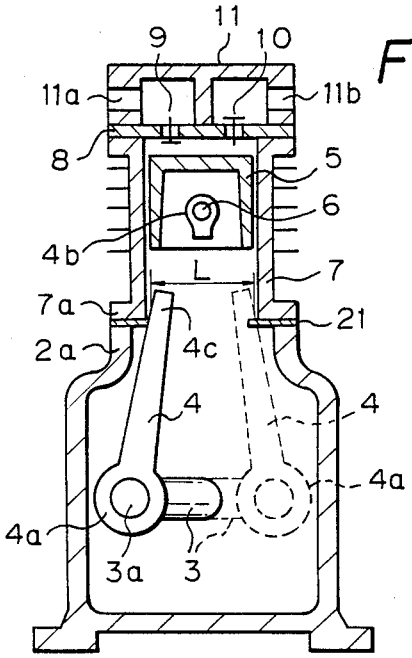
Fig. 7
Fig. 9
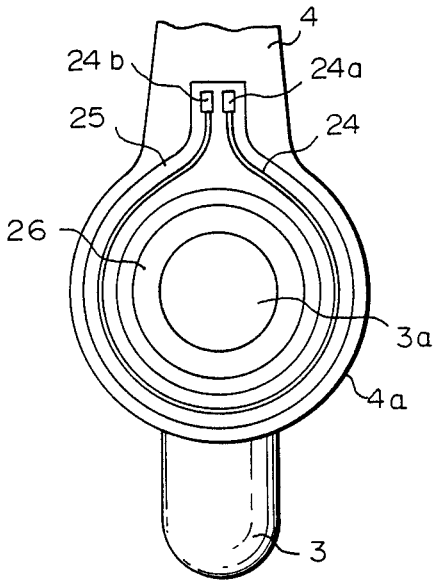
Fig. 8
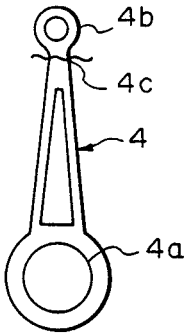

COMPRESSOR WITH CONDITION RESPONSIVE CUT-OFF MEANS

BACKGROUND OF THE INVENTION

This invention relates to a compressor, and more particularly, to a compressor which is designed to be brought to a halt when any abnormal operation of the respective constituent members of the compressor occurs and/or when the temperature inside the compressor rises abnormally.

One example of a compressor is a reciprocating compressor in which compressed air is designed to be discharged by the reciprocating motion of the piston connected to the connecting rod when the crankshaft is driven and rotated by the drive device, such as a motor or the like. With this type of reciprocating compressor, when the bolts for securing the cylinder fail to properly fulfill their function, the cylinder may, for example, start to vibrate. This would lead to the possibility of the connecting rod shearing off. However, there has to date been no capacity to provide conventional compressors with something like an abnormal-state detector.

Therefore, since with conventional compressors it is impossible to be made aware of the presence of an abnormal condition such as that where the constituent members of the compressor vibrate excessively, shear off or are deformed, or where the temperature thereof rises abnormally, the compressor is kept running even after such an abnormal state has arisen, Under such a condition, it may happen that tremendous stress is unexpectedly caused to act on the connecting rod such as to cause it to shear off. Nothing like an abnormal-state detector capable of detecting such shearing off of the connecting rod has conventionally been provided for compressors. As a consequence, crankshafts are kept running even after a connecting rod has sheared off, which causes the connecting rod to repeatedly and violently strike against the crankcase, cylinder and piston. Thus, the problem with conventional compressors is that the influence of the damaged connecting rod can be significant as it may cause secondary damage to develop, such as the case where a sheared-off connecting rod damages the crankcase, cylinder and piston. This is especially true when considering the recent tendency for lightweight compressors to be used in a wide range of applications. In these circumstances, it may happen that crankcases and so forth are made of die cast aluminium; in such cases the members described above would be so violently damaged as to be unusable if struck by the connecting rod.

In view of this, an object of the present invention is to provide a compressor which can solve the above-mentioned problems.

SUMMARY OF THE INVENTION

In order to solve the above problems, the present invention provides a compressor that includes a crankcase, a cylinder secured to the crankcase by securing means, a crankshaft disposed inside the crankcase and adapted to be rotated by a drive device, a piston reciprocatively installed inside the cylinder and a connecting rod adapted to connect the crankshaft to the piston in such a manner that the piston is reciprocated by the rotation of the crankshaft, wherein part of the drive power circuit of the drive device is constructed so as to be cut off when displacement of the constituent members of the compressor other than predetermined displacement occurs and/or when the temperature inside the compressor rises above a predetermined value.

In one embodiment of the present invention, part of the power circuit is designed to be cut off when displacement of the relative position of the cylinder and the crankcase occurs. With such a construction, when the securing means for securing the cylinder to the crankcase comes loose, the compressor is brought to a halt, the generation of any major secondary damage thus being prevented.

In another embodiment, part of the power circuit is designed to be cut off when the connecting rod is caused to be displaced beyond a predetermined operational range thereof.

In a further embodiment, part of the power circuit includes a material which melts when the temperature rises above a predetermined value.

BRIEF DESCRIPTION OF THE DRAWINGS

FIG. 7 is a vertical sectional view illustrating a state in which the connecting rod is damaged;

FIG. 8 is a front view of the connecting rod; and

FIG. 9 is an enlarged view of the larger-diameter end portion of the connecting rod utilized in the fourth embodiment of the present invention.

DESCRIPTION OF THE PREFERRED EMBODIMENT

Figure 1:
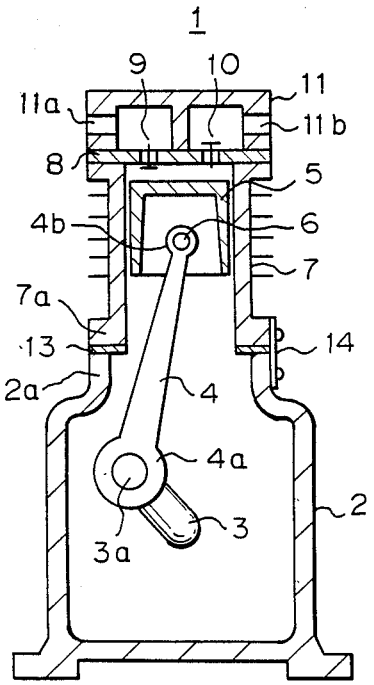
FIG. 1 is a vertical sectionaI view of a first embodiment of the compressor according to the present invention.
Figure 2:
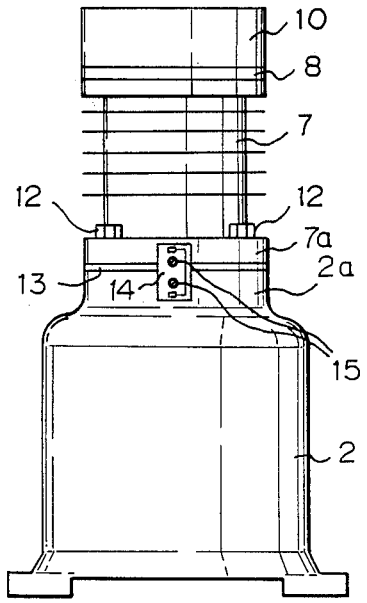
FIG. 2 is a front view, of the compressor.

In the preferred embodiment of the present invention, FIGS. 1 and 2 show a first embodiment of a compressor according to the present invention. The compressor 1 shown therein is a reciprocating compressor, in which compressed air is designed to be discharged by rotating a crankshaft 3 in a crankcase 2. Reference numeral 4 denotes a connecting rod having a larger diameter portion 4*a* and a smaller diameter portion 4*b* at its respective ends. The end portion 4*a* having a larger diameter is rotatably connected to the crankshaft 3 through a shaft 3*a* and the end portion 4*b* having a smaller diameter is rotatably connected to a piston 5 through a piston pin 6. Thus, the piston 5 is caused to reciprocate up and down inside a cylinder 7 by rotation of the crankshaft 3 through the connecting rod 4.

Provided on a valve seat 8 at the upper portion of the cylinder 7 are an inlet valve 9 and a delivery valve 10. When the piston 5 lowers, the inlet valve 9 opens, air thus being sucked into the cylinder 7 through an air-intake port 11*a* disposed in a cylinder head 11. When, on the other hand, the piston 5 rises, the delivery valve 10 opens, compressed air thus being discharged from a delivery port 11*b*.

The flange portion 7*a* of the cylinder 7 is secured by bolts 12 to the top portion 2*a* of the crankcase 2. A seal member 13 is disposed between the flange portion 7*a* and the top portion 2*a*.

Figure 3:
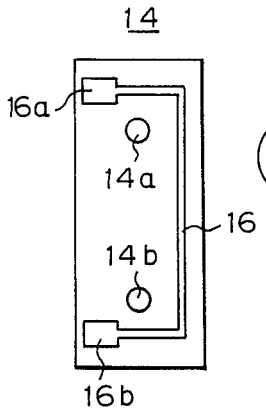
FIG. 3 is a plan view of the circuit board for detecting an abnormal state.

Reference numeral 14 denotes a circuit board for use as an abnormal-state detector, which is disposed in such a manner as to bridge the flange portion 7a and the top portion 2a at a certain peripheral position thereof and is secured thereto by fitting screws 15. The circuit board is formed of such materials as a fragile resin having relatively low strength or the like, and on its surface a current-carrying pattern 16 is formed as shown in FIG. 3. The current-carrying pattern 16 has a shape like a reversed "C" and holds electrodes 16a and 16b at the respective ends thereof. Provided at positions close to the ends of the circuit board 14 are fitting holes 14a and 14b for accommodating the fitting screws 15. The upper part of the circuit board 14 having the hole 14a is secured to the flange portion 7a of the cylinder 7, the lower part thereof having the hole 14b being secured to the top portion 2a of the crankcase 2.

Figure 4:
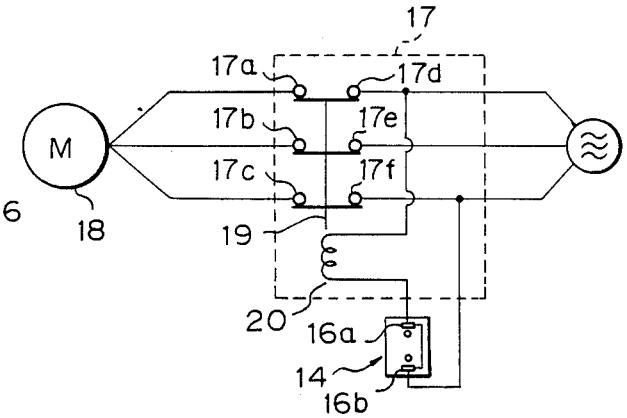
FIG. 4 is a circuit diagram of the motor.

As shown in FIG. 4, the current-carrying pattern 16 of the circuit board 14 is connected to a magnet switch 17, which is disposed between a motor 18 for driving the crankshaft 3 and a power source (not shown). The magnet switch 17 has a group of terminals 17a, 17b and 17c which are connected to the motor 18 and another group of terminals 17d, 17e and 17f which are connected to the power source. Reference numeral 19 is a travelling contact. When a coil 20 is excited, the travelling contact 19 is caused to move to a position which causes the contact 19 to bridge the gaps between the terminals 17a and 17d, the terminals 17b and 17e and the terminals 17c and 17f, respectively, and to remain there, electric current thus being allowed to pass therebetween. The coil 20 is connected to a cable extending from the terminal 17d at one end thereof and connected to the electrode 16a of the circuit board 14 at the other end thereof. Another electrode 16b of the circuit board 14 is connected to a cable extending from the terminal 17f. This allows the coil 20 to be connected to the power source through the current-carrying pattern 16 of the circuit board 14, the coil 20 thus being excited when the power source is turned on. Thus, electric current is allowed to pass to the motor 18 when the travelling contact 19 bridges and connects the gaps between each pair of corresponding terminals of the magnet switch 17 and the magnet switch 17 is thereby caused to close.

Under such a condition, take such a situation as that where the bolts 12 which secure the cylinder 7 to the crankcase 2 come loose while the compressor 1 is operating. When the bolts 12 begin to fail in their function of fastening those components together, the reciprocating motion of the piston 5 tends to cause the cylinder 7 to start vibrating in such a manner that it repeatedly comes into contact with and moves away from the crankcase 2. In these circumstances, the circuit board 14 which is secured to a certain peripheral position of the flange portion 7a and the crankcase 2 is cut off due to tensile force immediately the flange portion 7a becomes separated from the crankcase 2.

This also causes the current-carrying pattern 16 formed on the circuit board 14 to be broken, the passage of electric current to the coil 20 thence being cut off. This in turn disenergizes the coil 20 and thereby causes the travelling contact 19 which is being made to bridge the gaps between each pair of corresponding terminals to be separated from the terminals 17a to 17f, gaps thus being produced again between corresponding terminals. This opens the magnet switch 17, and the passage of electric current to the motor 18 is cut off, the compressor 1 thus being brought to a halt.

As is described above, the circuit board 14 in the present invention is designed to detect the loosening state of the bolts 12, which helps to eliminate any possibility of running the compressor 1 with the bolts 12 loose, as is often the case with a conventional compressor. Thus, the possibility of breaking the connecting rod 4 or damaging the crank-case 2 is also eliminated. In other words, detecting the occurrence of an abnormal state at an early stage protects the compressor 1 in advance against the severe damage which would be caused by the looseness of the bolts 12 or other abnormal states. The level of safety is thus improved with the compressor of the present invention.

Replacement of circuit boards 14 and tightening of the bolts 12 will suffice when repairing the compressor 1 after a halt of operations. In other words, a new circuit board merely has to be brought and secured to a predetermined position on the flange portion 7a and the crankcase 2 and the bolts 14 have to be tightened to secure again the cylinder 7 to the crankcase 2 since any risk of damage of the connecting rod and so forth is safely prevented. Thus, the work of repair can be simply completed.

As to the current-carrying material to be formed on the circuit board 14, possible materials are not limited to the current-carrying pattern 16 described above. Instead, a current-carrying material such as a wire or the like, or a signal wire and so forth can be utilized as alternatives.

Figure 5:
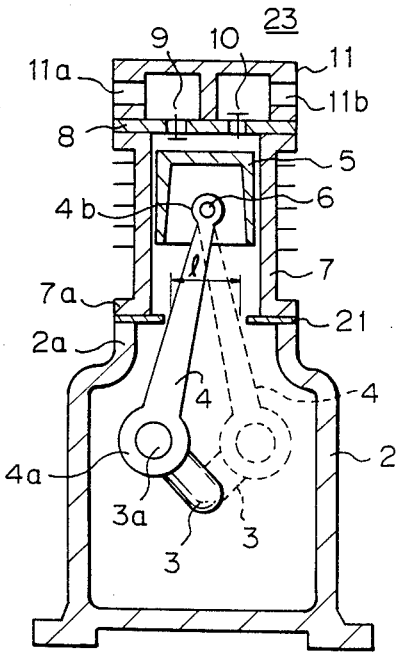
FIG. 5 is a vertical sectional view of a second embodiment of the present invention.
Figure 6:
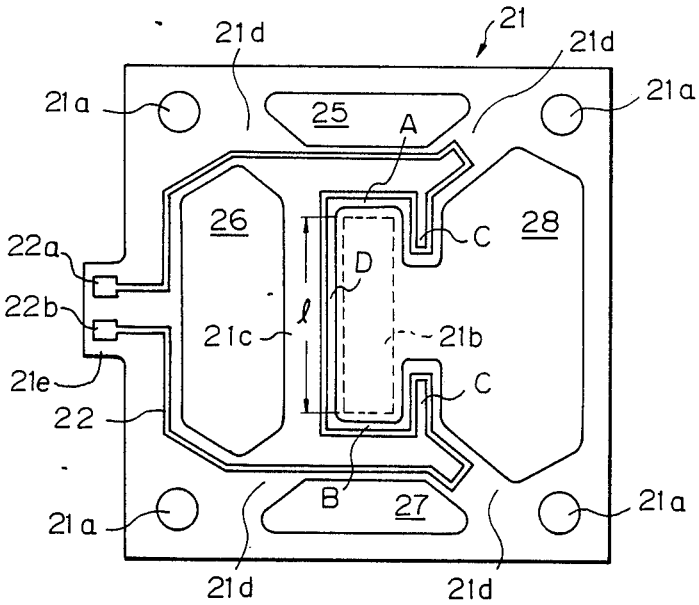
FIG. 6 is a plan view of the circuit board for detecting an abnormal state.

FIGS. 5 and 6 show a second embodiment according to the present invention. In these figures, like reference numerals are given to like components described in the first embodiment, and description thereof is omitted.

Reference numeral 21 is a circuit board for use as an abnormal-state detector, which is disposed as a seal member between the cylinder 7 and the crankcase 2. Due to this, the profile of the circuit board 21 i s substantially the same as that of the flange portion 7a of the cylinder, and in the four corners of the circuit board 21 small holes 21a are provided through which the bolts 12 (shown in FIG. 2) are put through.

In addition an opening 21b shaped like a reverse "C" is provided substantially in the center of the circuit board 21 to accommodate the connecting rod 4. Further, openings 25, 26, 27 and 28, the latter being formed so as to communicate with the opening 21b, are provided in such a manner as to surround the opening 21b. These openings, however, are provided as a matter of convenience in forming the circuit board 21 and have no direct relation to the features of the present invention. Thus, the circuit board 21 is composed of a surrounding portion 21c which surrounds the opening 21b and connecting portions 21d which extend towards the four corners and connect the surrounding portion 21c to the four corners thereof.

Furthermore, a current-carrying pattern 22 is formed on the circuit board 21 in such a manner that it surrounds the opening 21b and continuously extends over the respective connecting portions 21d, with the ends thereof being connected respectively to two electrodes 22a and 22b which are provided on a projection 21e projecting out of the flange portion 7a.

Similar to the case of the circuit board 14 of the first embodiment as shown in FIG. 4, the current-carrying pattern 22 formed on the circuit board 21 is connected to the coil 20 through the electrode 22a and to the power source through the other electrode 22b. In this construction, electric current is designed to pass to the coil 20 through the current-carrying pattern 22 on the circuit board 21, and the magnet switch 17 is thereby caused to close.

When the crankshaft 3 rotates and the piston 5 is caused to reciprocate inside the cylinder 7, the connecting rod 4 sways within a certain range, namely, within the range restricted by the solid and dashed lines as shown in FIG. 5. The transverse displacement of the connecting rod 4 within the opening 21b in the circuit board 21 is expressed by a dimension "l". Namely, as shown in FIG. 6, the connecting rod 4 is designed to sway within the range restricted by a dashed line.

The opening 21b is made to be a little wider than the operational range of the connecting rod 4. Due to this, as long as the connecting rod 4 operates normally, the rod is prevented from being brought into contact with the periphery of the opening 21b.

However, if the bolts 12 securing the cylinder 7 come loose while a compressor 23 is operating, the cylinder will start to vibrate and intolerable stress will be caused to act on the connecting rod 4. As a result, there will be a possibility of the connecting rod 4 shearing off at its neck portion 4c which is close to the end having a smaller diameter 4b, as shown in FIGS. 7 and 8.

As shown in FIG. 7, when the connecting rod 4 is sheared off as described above, the sheared-off neck portion 4c becomes free. Under this condition, when the crankshaft 3 goes on rotating, the damaged connecting rod 4 is left free to sway in a fashion shown by solid and dashed lines in FIG. 7 and eventually sways beyond a predetermined operational range defined in the opening 21b in the circuit board 21. This beyond-the-range operation of the connecting rod 4 is shown by a dimension "L" ("L" > "l").

As is described above, immediately the neck portion 4cbecomes damaged, the connecting rod 4 starts to be forcibly displaced in a transverse direction such as to strike against the circuit board 21. In other words, after it has been sheared off, the connecting rod 4 is caused to strike against either part A or part B of the surrounding portion 21c of the circuit 21 to cause the same to shear off. At the same time, the current-carrying pattern 22 formed on either part A or part B is also cut off.

As a result of the above, the passage of electric current to the coil 20 is cut off, which in turn halts the rotation of the motor 18. This means that the breakage of the connecting rod 4 can be detected through the damage of the circuit board 21 which serves as an abnormal-state detector, the compressor 23 thus being brought to a halt.

As is described above, since the compressor 23 is caused to halt immediately the connecting rod 4 is sheared off, the rod 4 is prevented from striking violently against the cylinder 7 and the crankcase 2, these members thus being protected in advance from possible damage. Furthermore, since it is only the connecting rod 4 that is damaged, replacement of connecting rods 4 and circuit borads 21 will suffice when repairing the compressor 23, and after these components have been replaced properly, the compressor 23 can be started again.

Turning to the larger-diameter end portion 4a of the connecting rod 4, a bearing is provided therein to accommodate the shaft 3a of the crankshaft 3. While the compressor 23 is operating, axial displacement of the relative position of the bearing and the shaft 3a may for some reason occur. Under such a condition, the connecting rod 4 is displaced axially of the shaft 3a from its predetermined position relative to the crankshaft 3.

When this kind of abnormal state happens, the connecting rod 4 is caused while it is operating to strike against part C or part D of the surrounding portion 21c of the circuit board 21 such as to cause these parts to shear off, the current-carrying pattern 22 formed on the part C or D thus also being cut off. This cuts off the passage of electric current to the motor 18 and the compressor 23 is thus caused to halt.

Referring again to FIGS. 5 to 8, a third embodiment of the present invention will now be described as below.

It is the characteristic feature of the third embodiment that the current-carrying pattern 22 provided on the circuit board 21 is formed of an alloy having a low melting point.

Normally, a breather valve (not shown) is provided in the crankcase 2 to allow the ingress and egress of air while the piston 5 is making reciprocating motions, and the breather valve is provided with a filter (not shown) for dust-elimination purposes. It may happen that such a filter becomes clogged after long use, and this causes the temperature inside the crankcase 2 to rise abnormally high during the operation of the compressor 23, which in turn causes grease to bleed from, for example, the bearing (not shown) provided at the larger-diameter end portion 4a of the connecting rod 4 or the smaller diameter end portion 4b thereof. Thus, the smooth relative rotation of the crankshaft 3 and the connecting rod 4, or the connecting rod 4 and the piston pin 6 tends to be lost, and these members are thus liable to become locked. Eventually, an untoward force of some kind is likely to bear upon the connecting rod 4 such as to cause it to shear off.

In the present embodiment, however, the current-carrying pattern 22 provided on the circuit board 21 is formed of an alloy having a low melting point. Due to this, in a case where the temperature inside the crankcase 2 rises to a predetermined value, the current-carrying pattern 22 is caused to melt before any grease starts to bleed out. This causes the drive power device to be cut off, the compressor 23 thus being brought to a halt.

FIG. 9 is an enlarged view of the larger-diameter end portion of the connecting rod employed in a fourth embodiment of the present invention.

In this embodiment, a circuit board 25 of a nonconductive material is mounted on the larger-diameter end portion 4a of the connecting rod 4 in such a manner that it surrounds a bearing 26, and on the circuit board 25 is provided a current-carrying pattern 24 of an electrically conductive material. Electrodes 24a and 24b are provided at the ends of the current-carrying pattern 24, and they are connected to the magnet switch for controlling the drive power source, as in the first to the third embodiments (refer to FIG. 4).

In this embodiment, the temperature increases occurring in the proximity of the bearing 26 are designed to directly melt the current-carrying pattern 24. The location of the current-carrying pattern 24 is not in fact restricted to the larger-diameter end portion 4a of the connecting rod 4. Instead, it can be located around the bearing of the smaller-diameter end portion 4b of the connecting rod 4 or on both bearings, as alternative positions.

Moreover, a plurality of abnormal-state detectors in the form of a circuit board having a current-carrying pattern and an alloy having a low melting point can be provided on each of the constituent parts of a compressor so as to detect troubles occurring at several parts at the same time by combining said plurality of abnormal-state detectors.

The compressor of the present invention is superior to the conventional ones in the following points.

As described above, since the compressor according to the present invention enables detection at arbitrary constituent places of the occurrence of abnormal states with respect to vibration, severance, deformation, temperature rises and so forth, the damage caused by occurrence of an abnormal state is prevented from developing further by not only serving to detect the occurrence of an abnormal state but also to stop the relevant driving source. In addition, the compressor according to the present invention can improve the level of safety during operation thereof by detecting occurrence of an abnormal state at an early stage and thereby halting operation of the compressor before any secondary damage develops.

What is claimed is:

1. An air compressor including:

a crankcase;

a cylinder secured to said crankcase;

a crankshaft disposed inside said crankcase;

a drive means connected to said crankshaft and having a drive power circuit means for supplying power to drive said drive means in rotation;

a piston reciprocatively movable in said cylinder;

a connecting rod connecting said crankshaft to said piston for reciprocating said piston by the rotation of said crankshaft and being movable through a predetermined displacement during the reciprocating movement of said piston; and means connected to said power drive circuit means and responsive to movement of said crankshaft other than in said predetermined displacement for interrupting said power drive circuit means for thereby stopping rotation of said crankshaft and movement of said connecting rod.

2. An air compressor as claimed in claim 1 in which said power drive circuit means includes a conductor member, and said means for interrupting said power drive circuit means comprises a plate-like member on which said conductor member is positioned, said plate-like member being inside said compressor and having an opening therein through which said connecting rod extends and having edges spaced slightly from the limits of the predetermined displacement of said connecting rod for being struck by said connecting rod when said connecting rod moves in other than said predetermined displacement and for thereby breaking said conductor member.

3. An air compressor as claimed in claim 2 on which said conductor member is in the vicinity of the edge of said opening.

* * * * *